US005548389A

United States Patent [19]

Bowler, Jr.

[11] Patent Number: 5,548,389

[45] Date of Patent: Aug. 20, 1996

[54] VARIABLE POSITION STRIPPER SYSTEM FOR CURL REDUCTION

[75] Inventor: Edward F. Bowler, Jr., Fairport, N.Y.

[73] Assignee: Xerox Corporation, Stamford, Conn.

[21] Appl. No.: 359,127

[22] Filed: Dec. 19, 1994

[51] Int. Cl.[6] ..... G03G 21/00

[52] U.S. Cl. ..... 355/311; 355/315; 355/285

[58] Field of Search ..... 355/311, 315, 355/282, 285, 290, 207, 309; 271/900; 162/271, 197

[56] References Cited

U.S. PATENT DOCUMENTS

| | | | |
|---|---|---|---|
| 4,571,054 | 2/1986 | Bowler, Jr. | 355/35 H |
| 4,591,259 | 5/1986 | Kuo et al. | 162/271 X |
| 4,926,358 | 5/1990 | Tani et al. | 364/562 |
| 5,066,984 | 11/1991 | Coombs | 355/309 |
| 5,084,731 | 1/1992 | Baruch | 355/208 |
| 5,153,662 | 10/1992 | Foos | 355/309 |
| 5,202,737 | 4/1993 | Hollar | 355/309 X |
| 5,237,381 | 8/1993 | Hamada | 355/321 |
| 5,270,778 | 12/1993 | Wyer | 355/311 |
| 5,357,327 | 10/1994 | Solano et al. | 355/282 |
| 5,392,106 | 2/1995 | Bigenwald et al. | 355/309 |
| 5,414,503 | 5/1995 | Siegel et al. | 355/309 |

*Primary Examiner*—R. L. Moses

[57] ABSTRACT

Copy sheet decurling mechanism employed in conjunction with a heat and pressure fuser for reducing or eliminating the curl induced into the copy sheets by the fuser roll of the fuser. Stripper fingers, the position and/or angle of which can be selectively varied, are provided for reverse (i.e. direction opposite to bending caused by the pressure roll) bending of the copy sheets while they are in a plastic state, that is while the sheets are still at an elevated temperature.

5 Claims, 4 Drawing Sheets

VARIABLE POSITION STRIPPER SYSTEM FOR CURL REDUCTION

BACKGROUND OF THE INVENTION

This invention relates to fuser apparatus for heat and pressure fusing toner images to sheets of support material such as plain paper. More particularly, the invention relates to apparatus and a method for reducing sheet curl induced into image substrates by roll fusers of the type employed in xerographic or similar machines.

In a typical electrophotographic printing or copying process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an abhesive material, such as a silicone rubber or other low surface energy elastomer or, for example, tetrafluoroethylene resin sold by E. I. DuPont De Nemours under the trademark Teflon. The pressure roll contacts the heated fusing roll to form the aforementioned nip through which the image carrying substrates pass. The pressure roll may also be coated with an abhesive layer. Alternately, these rolls may be provided with an abhesive outer layer comprising silicone rubber.

One problem encountered in electrostatic printing or xerography in office copiers and printers in which the image is fused on the paper under heat and pressure is that the process tends to cause a curl to be formed in the paper. Curled paper is difficult to handle in a receiver for the sheets. Ideally the sets should be neat with edges aligned and easy to handle by an operator or in finishing apparatus in which the set may be stitched or stapled.

The curl problems with sheets of paper stem from the treatment of the sheets in the processor. A sheet of normal paper is taken from a supply cassette or feeder, in an environment in which the paper is subject to humidity and absorbs a certain amount of moisture. The sheet is processed past a photoconductor where powder or liquid ink is applied to produce an image, and then the sheet is passed through a fuser and subjected to heat and pressure between rollers, with the result that curl is induced into normally flat sheets. Curled sheets received in a collator or sorter in bins cause failure of the device due to jamming or mis-sorting of sheets and the bin capacity of the receiver is reduced. In addition, curled sheets do not tend to form neat stacks or sets.

The gravity of the aforementioned problem varies depending on a number of factors. Large variations in Toner Mass Area (TMA) cause more or less curl. More importantly, as the TMA varies from low to high or vice-versa, the direction of curl changes. Low TMA prints typically produce curl which is directed away from the image while high TMA prints typically produce curl which is directed toward the image.

The degree of curl also is a function of paper weight. Light weight papers generally need more curl correction than the thicker heavy papers. Additionally, some papers are known to be heavy curlers.

Following is a discussion of prior art and other disclosures, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,571,054 granted to Edward F. Bowler, Jr. on Feb. 18, 1986 relates to the art of xerography and analogous graphic arts and more particularly to a copy sheet decurling mechanism employed in conjunction with a heat and pressure fuser for reducing or eliminating the curl induced into the copy sheets by the pressure roll of the fuser. To this end, means are provided for reverse (i.e. direction opposite to bending caused by the pressure roll) bending of the copy sheets while they are in a plastic state, that is while the sheets are still at an elevated temperature.

U.S. Pat. No. 5,237,381 discloses a sheet discharging apparatus having a curl generating device wherein a curl is generated in a sheet while the sheet is passing through the curl generating device, and a first guide disposed downstream of the curl generating device and switchingly movable between a first position where the sheet is directed toward a curved sheet path and a second position where the sheet is directed toward a direction the same as a sheet feeding direction from the curl generating device. The apparatus further has a sheet discharge guide disposed between the curl generating device and the first guide and switchingly movable in synchronism with the switching movement of the first guide to change its posture, between a position where the sheet discharged from the curl generating device is curled reversely and a position where the sheet discharged from the curl generating device is not further curled.

U.S. Pat. No. 5,066,984 discloses a device disposed in the path of paper sheets leaving a printing unit or processor such as an office copier or non-impact printer and has an arcuate concave guide and a roll spaced from the guide to form a sheet path which is curved or arched oppositely to the direction in which the sheet is curled in the processor. The space between the guide and the roller is greater than the thickness of the paper and the paper is bent in the direction opposite to its curl as it passes through the arched space, while the beam strength of the paper and the change in direction of the paper maintain adequate drive friction on the sheet. A selector isolates the de-curler when it is not needed.

U.S. Pat. No. 5,066,984 discloses a sheet stripping and guide assembly, suitable for use at the exit of an electrostatographic fusing station has lower stripper fingers that are inserted and molded integrally into a frame having upper sheet guide members.

BRIEF SUMMARY OF THE INVENTION

In accordance the present invention, there is provided a heat and pressure fuser for fixing powder or toner images. The fuser comprises a pair of rollers which are pressure engaged for forming a nip through which substrates carrying toner images are passed. The toner image contacts a heated roller of the roll pair forming the fuser. It will be appreciated that the nip can be formed by either of the two rolls being deformed by the other.

One or more stripper fingers are provided for removing copy sheets from the fuser roll. The stripper finger or fingers are adapted to be repositioned relative to the fuser roll such that the angle of contact with the roll is also varied. The angle of contact with the fingers with their respective rolls depends on paper weight and/or TMA on the copy sheet. The point of contact of the stripper fingers with the surface of the fuser roll may also be varied together with the repositioning thereof.

The angle of contact of the stripper fingers is adjusted automatically by virtue of input through a User Interface (UI) and other machine components. Information regarding paper weight can be input using the UI while TMA can be approximated by counting image pixels using a Raster Input Scanner (RIS). This information is processed in accordance with an algorithm stored in computer memory.

DETAILED DESCRIPTION OF THE PREFERRED EMBODIMENT OF THE INVENTION

Figure 4:
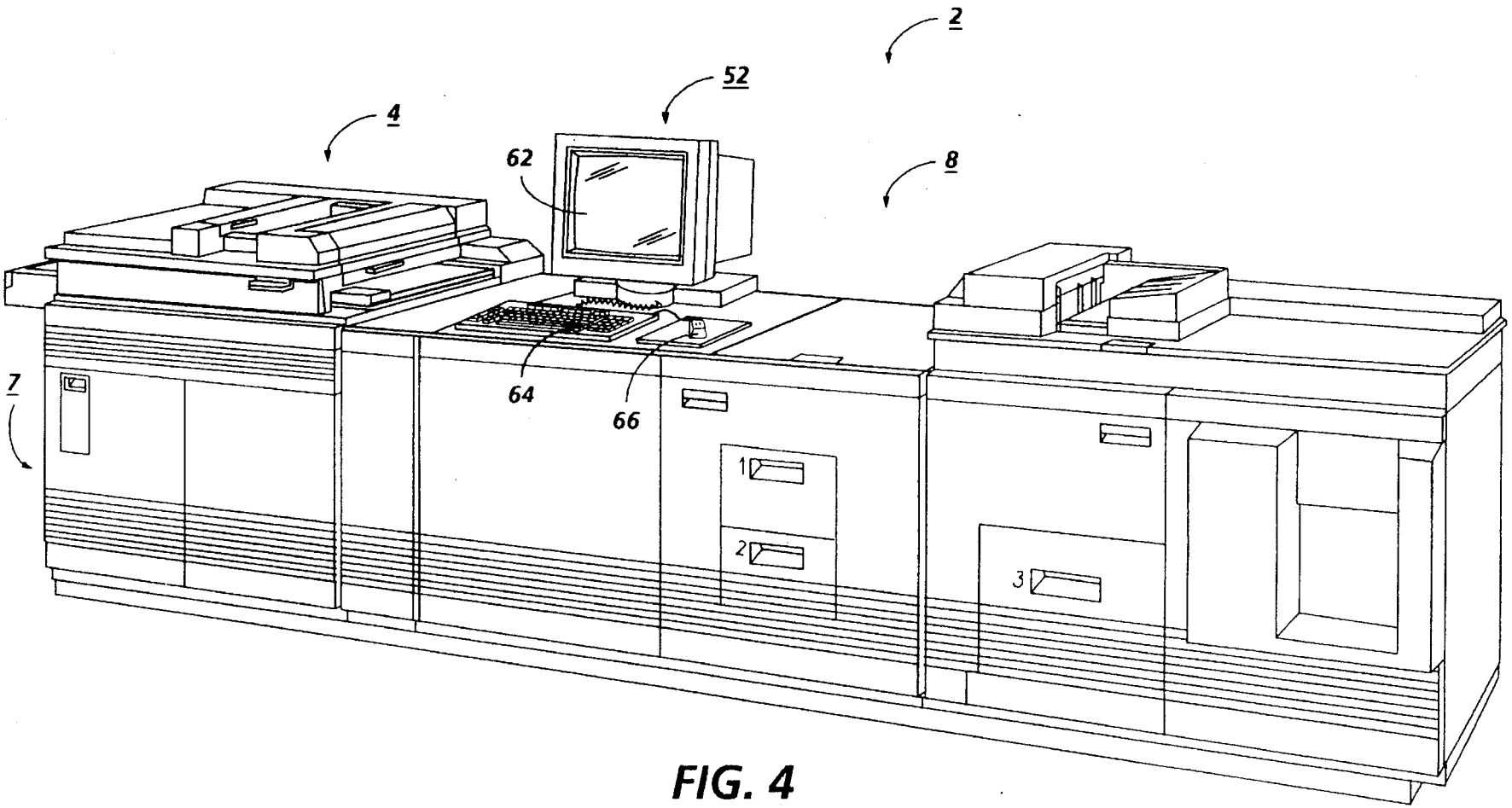
FIG. 4 is a view of an electronic printing system.

Referring to FIG. 4, there is shown a laser based printing system 2 in which the present invention may be utilized. The printing system 2 comprises a scanner section 6, controller section 7, and printer section 8. The document illumination control and calibration circuits to be discussed below are associated with scanner section 6. While a specific printing system is shown and described, the present invention may be used with other types of printing systems such as light lens copying onto a photoreceptor, ink jet, ionographic, etc.

Figure 2:
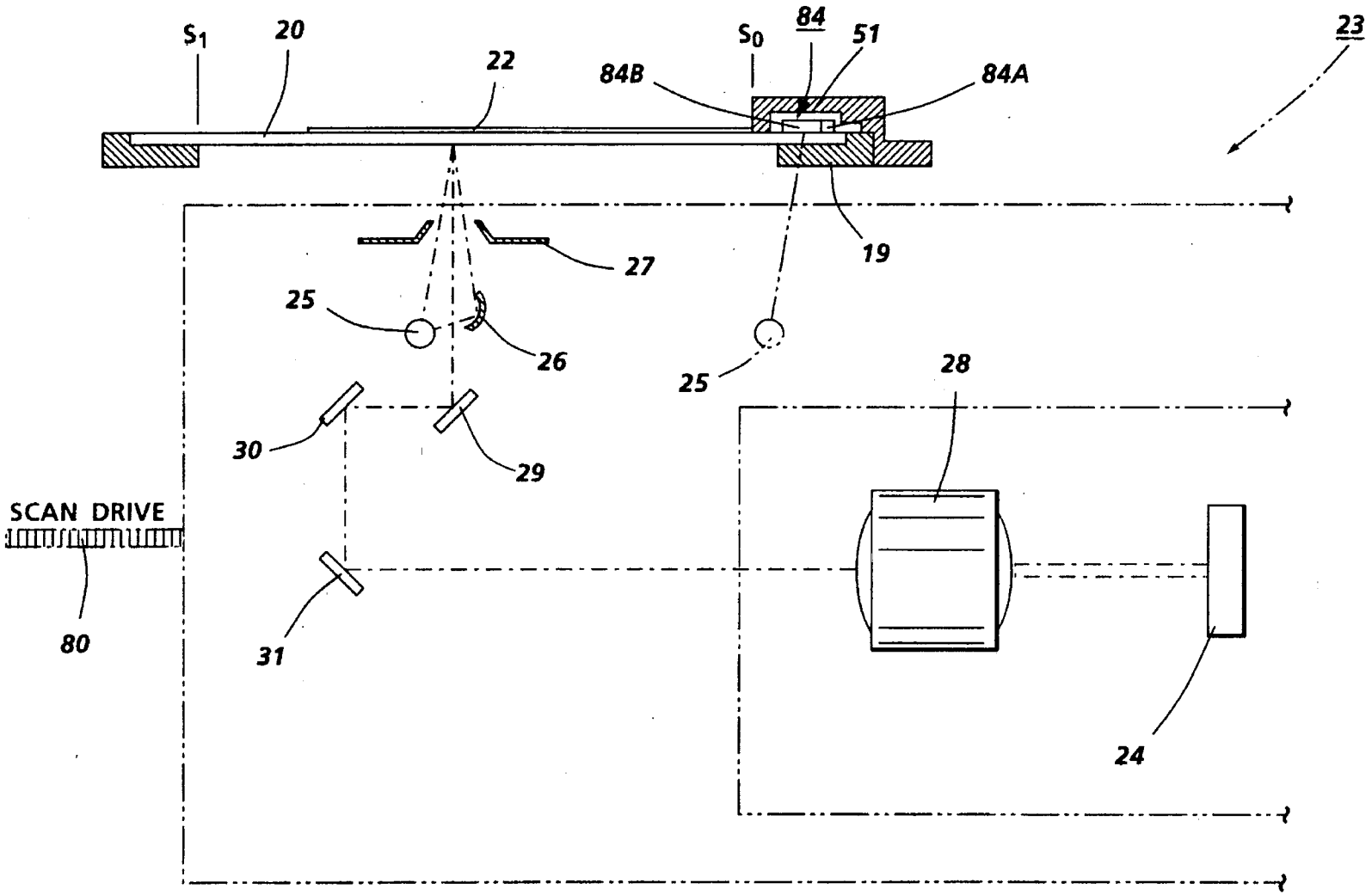
FIG. 2 is a block diagram of the major elements of the printing system shown in FIG. 4.
Figure 3:
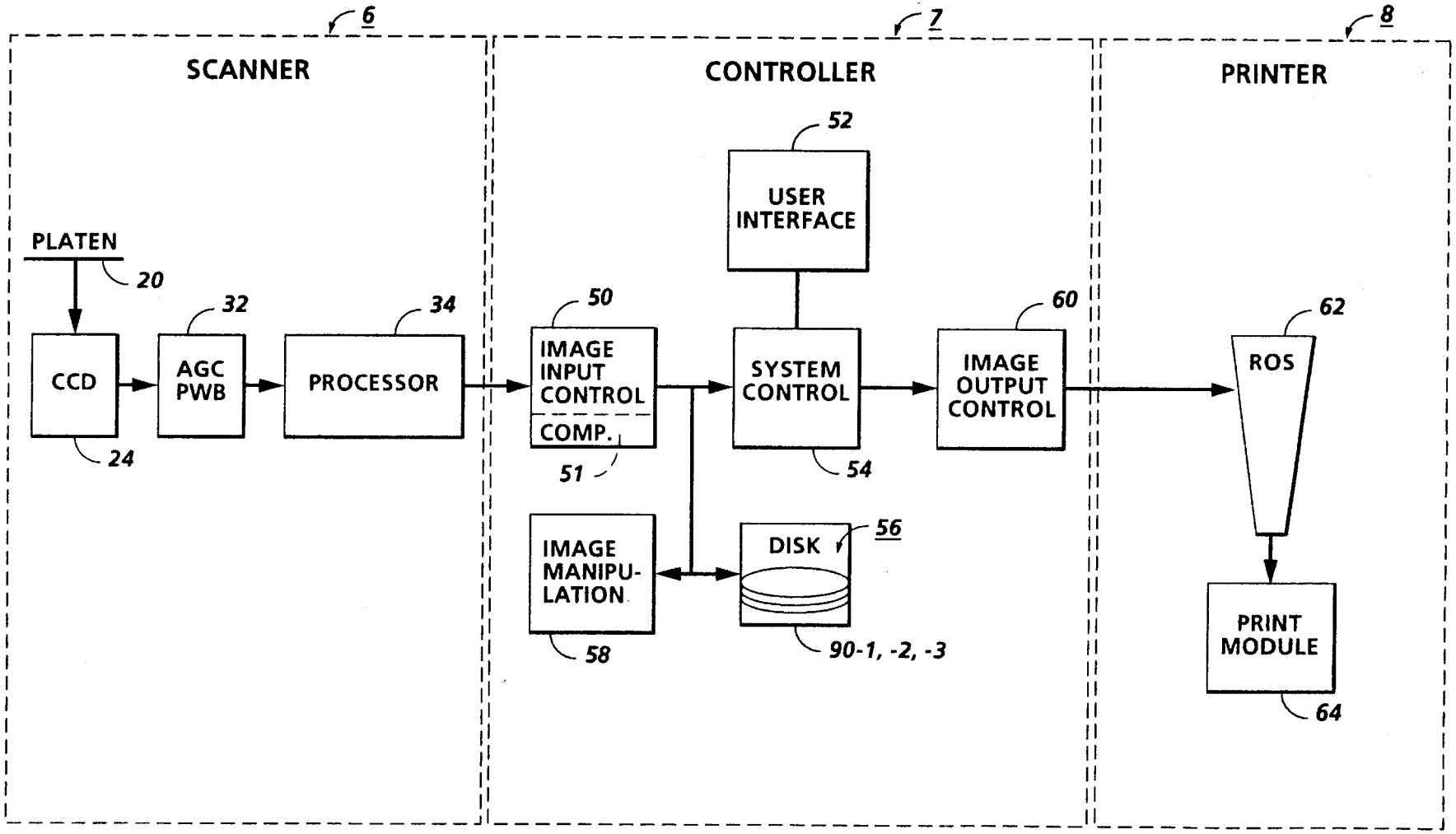
FIG. 3 is an enlarged schematic view of the RIS scanning system for the printing system shown in FIG. 2.

Referring particularly to FIG. 2, scanner section 6 incorporates a transparent platen 20 on which a document (FIG. 3) 22 to be copied is located. One or more linear arrays 24 are supported for reciprocating scanning movement below platen 20. An optical assembly 23 comprises a plurality of optical components which move together as a single unit. The components include a linear, fluorescent lamp 25, associated reflector 26, and baffle 27, the latter two elements cooperating to direct a narrow band of light onto an incremental area of the platen. Also included in assembly 23 are a lens 28, and mirrors 29, 30, and 31, which cooperate to focus the illuminated line-like segment of platen 20 and the document being scanned thereon, onto array 24. Array 24 produces image signals or pixels representative of the image scanned which, after suitable processing by processor 34, are output to controller section 7. The document is registered against the edge of registration guide 51 (FIG. 3), and scanning takes place from start of scan position $S_0$ to end of scan position $S_1$. The scanner may comprise a calibration reference strip 84 extending along the platen width beneath the guide 51. Strip 84 has a first linear white segment 84A and a second linear black segment 84B.

Output analog signals from array 24 are analog gain/adjusted and converted to 8 bit gray level digital signals in AGC circuit 32 and sent to processor 34. Processor 34 converts the digital input signals to single bit digital output signals, normalizes and processes the digital image signals as required to enable system 2 to store and handle the image data in the form required to carry out the job programmed. Processor 34 also provides enhancements and changes to the image signals such as filtering, thresholding, screening, cropping, scaling, etc. Referring to FIG. 2, controller section 7 is, for explanation purposes, divided into an image input controller 50, user interface (UI) 52, system controller 54, main memory 56, image manipulation section 58, and image output controller 60. As best seen in FIG. 4, UI 52 includes a combined operator controller/CRT display consisting of an interactive touchscreen 62, keyboard 64, and mouse 66. UI 52 interfaces the operator with printing system 2, enabling the operator to program print jobs and other instructions, to obtain system operating information, instructions, programming information and, most pertinent for purposes of the present invention, information representing image substrate properties such as the weight thereof. Items displayed on touchscreen 62 such as files and icons are actuated by either touching the displayed item on screen 62 with a finger or by using mouse 66 to point cursor 67 for selection of a desired function. For example, screen 62 may provide access to an icon or series of icons 63 representative of different paper weights.

Main memory 56 has plural hard disks 90-1, 90-2, 90-3 for storing machine Operating System software, algorithms, and the scanned image data currently being processed.

When the compressed image data in main memory 56 requires further processing, or is required for display on touchscreen 62 of UI 52, or is required by printer section 8, the data is accessed in main memory 56. Where further processing other than that provided by processor 34 is required, the data is transferred to image manipulation section 58 on PWB 70-6 where the additional processing steps such as collation, make ready, decomposition, etc. are carried out. Following processing, the data may be returned to main memory 56, sent to UI 52 for display on touchscreen 62, or sent too image output controller 60. The scanned image data input from processor 34 of scanner section 6 is operated on by controller section 7. The output of controller 7 operates a Raster Output Scanner (ROS) 62 in printer section 8. ROS 62 incorporates a laser which generates output beams which are in turn scanned across a moving photoreceptor located in print module 64. Image lines are exposed at the photoreceptor with each scan cycle to create latent electrostatographic images.

Figure 1:
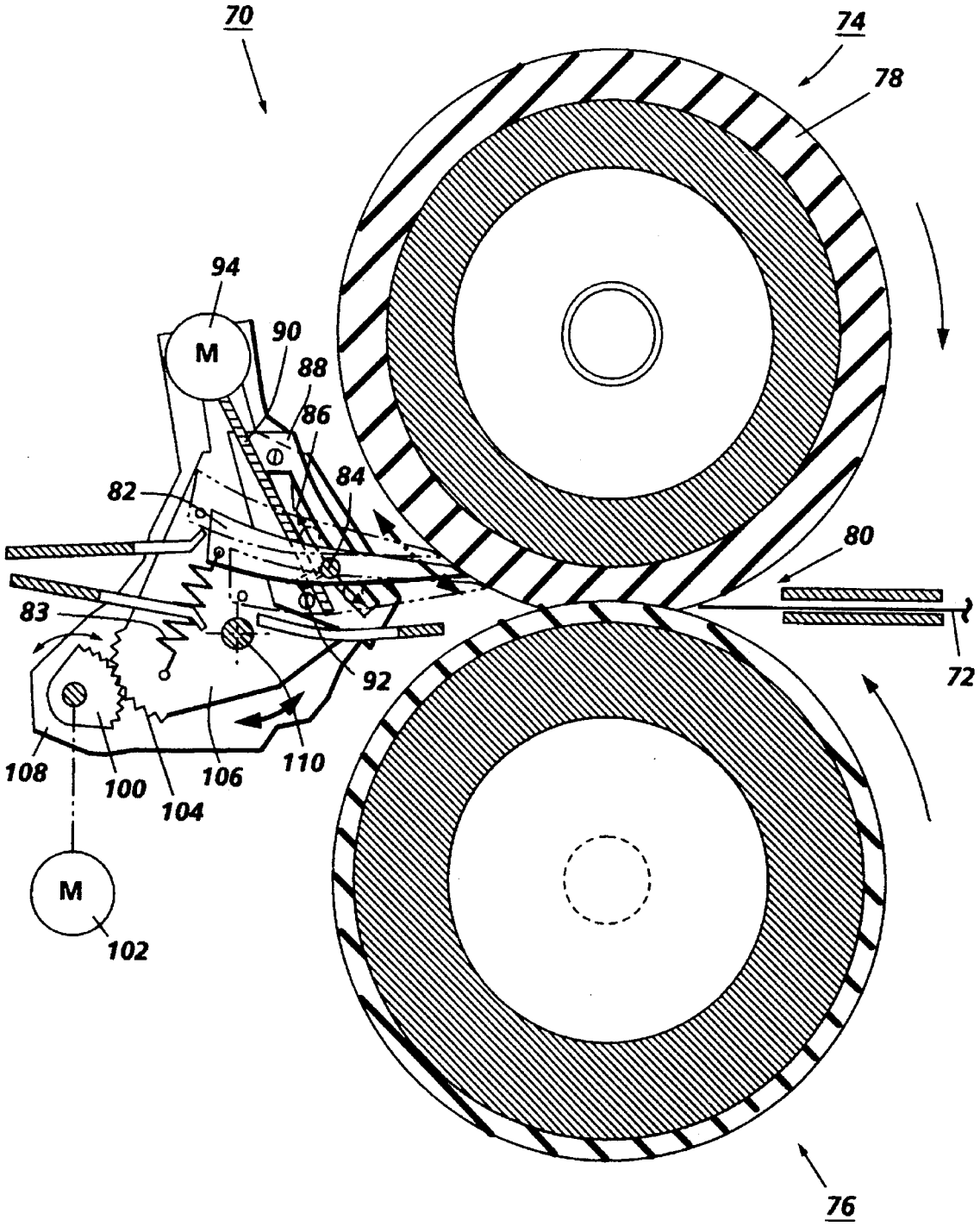
FIG. 1 illustrates a heat and pressure fuser depicting features of the present invention.

A fuser apparatus, FIG. 1 indicated generally by the reference numeral 70 permanently affixes toner powder images to sheet 72. Preferably, fuser apparatus 70 includes a heated fuser roller 74 adapted to be pressure engaged with a backup or pressure roller 76 with the toner powder images contacting the heated fuser roller 74. In this manner, the toner powder image is permanently affixed to sheet 72. The fuser roll 74 comprises a relatively thick (i.e., 10–60 mils) coating or layer 78 of silicone rubber which is deformable by the harder pressure roller 76. After fusing, a sheet 72 is directed to a catch tray not shown, for removal from the printing machine by the operator.

The fuser apparatus 70, as shown in FIG. 1 of the drawings, comprises the centrally heated roll 74 which is supported above the pressure roll 76. To fuse the toner images carried by the copy sheets the sheets are moved through a nip 80 formed between the two rolls such that the images contact the heated roll. A plurality of stripper fingers 82 (only one of which is shown) are provided to ensure removal of the copy sheets from the fuser. The fingers are preferably fabricated from a resin material such as Teflon (a trademark of E. I. duPont). The tips of the fingers biased, by means of a bias spring 82, into contact with the surface of the fuser roll at a point downstream of the nip 80. The bias spring is secured adjacent to the end thereof opposite its tip. The fingers are adapted to be positioned at various positions and angles relative to the surface of the fuser roll 74. The purpose of such positioning of the fingers is so that they can effect a reverse bending of copy sheets of different weights and copy sheets having varying amounts of toner forming the images thereon, such bending being in the direction opposite to that induced during the fusing of the toner image. This reverse bending has the effect of straightening out or effecting decurling of the copy sheets.

Each of the stripper fingers, as illustrated in FIG. 1, is attached to a pivotably mounted rod member 84 which is adapted to ride in slots 86 in a guide member 88, only one being shown). A lead screw 90 threaded through a nut 92 secured to one of the fingers 82 serves to move the rod in the slots 86 thereby effecting the point of contact of each stripper finger with the surface of the fuser roll. To this end, a stepper motor 94 is provided. The operative position of the stripper fingers is a function of the weight of a particular sheet being fused and the amount of toner used in forming the image thereon. A value corresponding to paper weight is manually entered into the electronics of printer via the series of icons accessible through the UI 52. Additionally, toner area coverage or TMA is determined in accordance with pixel count information which together with the paper weight information is used in an algorithm stored in computer memory for deriving signals for controlling the positioning of the stripper fingers.

Signals derived using the aforementioned algorithm are employed for actuating the stepper motor 94 which, in turn, drives the lead screw 90 to vary the position of the stripper fingers in the slots and ultimately the point of contact of the stripper fingers with the surface of the fuser roll.

While the placement of the of the fingers in the slots 86 serves to alter the contact point between the stripper fingers and the fuser roll surface the angle of the stripper varies slightly. Larger variations in stripper finger angles relative to the fuser roll may be accomplished using a sector gear 100 and stepper motor 102. The sector gear engages teeth 104 provided in a mounting plate 106. The sector gear and plate 106 are secured to a machine frame member 108, partially shown in FIG. 1. The plate 106 is pivotably mounted to the frame member 108 with shaft member 110. The stepper motor may also be actuated using signals derived form the same information as that used for the operation of the stepper motor 94, that is, image pixel count representing toner coverage and substrate characteristics such as weight which is derived through the UI 52.

I claim:

1. In a xerographic reproducing apparatus including a heat and pressure roll fuser for fixing toner images to copy sheets, the improvement comprising:

decurling means for removing curl induced into said copy sheets by roll forming a part of said roll fuser; and substrate decurling means operable in various modes in accordance with the weight of a copy substrate and or the amount of toner forming Images thereon, said decurling means comprising means for separating copy sheets from said fuser roll.

2. Apparatus according to claim 1 wherein said decurling means comprises a plurality of stripper fingers contacting a heated roll.

3. Apparatus according to claim 2 wherein said decurling means comprises means for adjusting the point of contact of said stripper fingers with said heated roll depending on the type of substrate to which images have been fused and or the amount of toner forming images on said substrates.

4. Apparatus according to claim 3 including means for varying an angle of contact of said stripper fingers with said heated roll according to the type of substrate to which images are fused and or the amount of toner used to form said images.

5. Apparatus according to claim 4 wherein said means for varying the angle and point of contact are capable of operating simultaneously.

* * * * *